United States Patent [19]

Uhlig

[11] 3,984,021

[45] Oct. 5, 1976

[54] SAFETY CLOSURE CONTAINER

[76] Inventor: Gerhardt E. Uhlig, 5875 N. Yermo, Apt. E-4, Toledo, Ohio 43613

[22] Filed: June 3, 1974

[21] Appl. No.: 475,593

Related U.S. Application Data

[60] Division of Ser. No. 288,129, Sept. 11, 1972, Pat. No. 3,830,391, which is a continuation of Ser. No. 16,427, March 4, 1970, abandoned.

[52] U.S. Cl. ..... 215/216; 215/217

[51] Int. Cl.[2] ..... B65D 55/02; B65D 85/56; A61J 1/00

[58] Field of Search ..... 215/217.9, 216, 218

[56] References Cited

UNITED STATES PATENTS

| | | | |
|---|---|---|---|
| 2,752,060 | 6/1956 | Martin | 215/216 |
| 2,827,193 | 3/1958 | Martin | 215/217 |
| 3,376,991 | 4/1968 | Deaver | 215/217 |
| 3,399,796 | 9/1968 | Steiner | 215/217 |

*Primary Examiner*—George T. Hall
*Attorney, Agent, or Firm*—Paul F. Stutz

[57] ABSTRACT

A container and closure construction featuring locking arrangements in the form of registering dent(s) and projection(s) formed on said container and closure which engage easily and disengage only through purposeful mind-controlled manipulation thereof, coupled with flexing of one of said container or closure to accomplish said disengagement. A screw thread coupling of closure and container represents a preferred embodiment.

3 Claims, 30 Drawing Figures

FIG.16
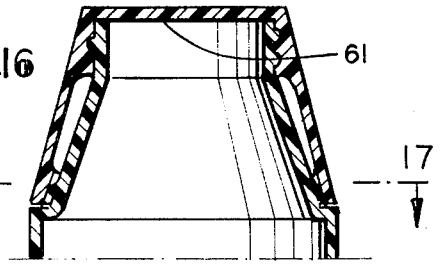
FIG.17
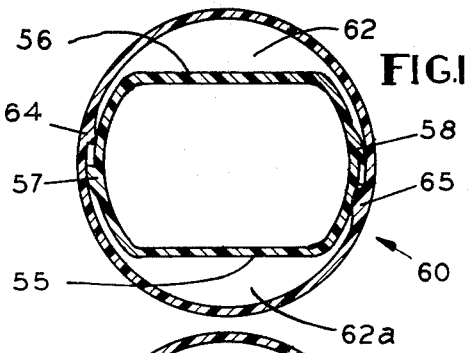
FIG.18
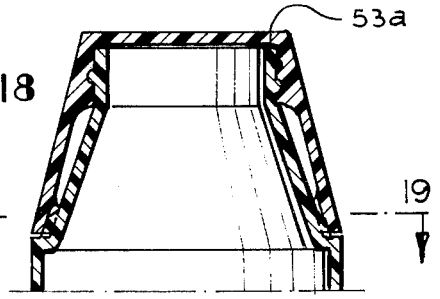
FIG.19
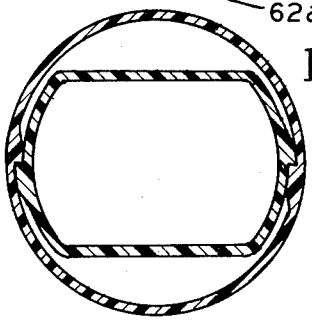
FIG.20
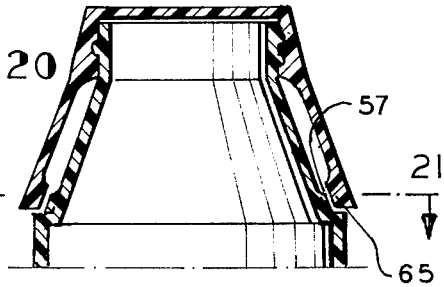
FIG.21
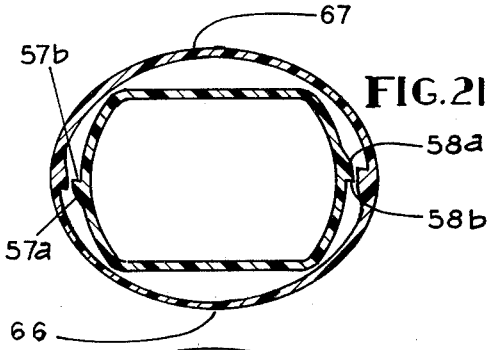
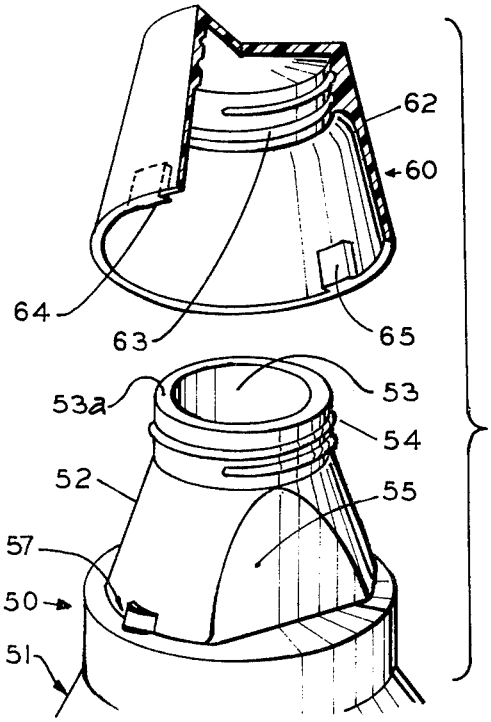
FIG.15
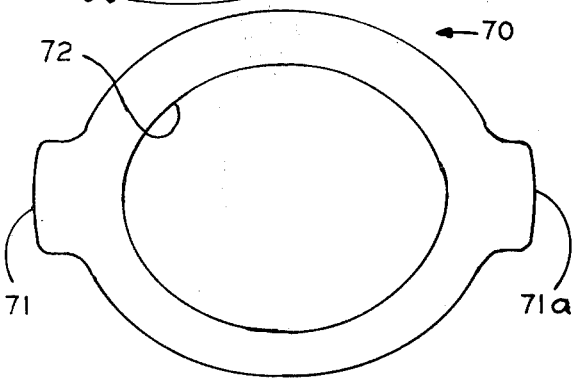
FIG. 22

SAFETY CLOSURE CONTAINER

This is a division of application Ser. No. 288,129, filed Sept. 11, 1972, now U.S. Pat. No. 3,830,391, issued Aug. 20, 1974, which application Ser. No. 288,129 is a continuation of application Ser. No. 16,427, filed Mar. 4, 1970, now abandoned.

The present invention contemplates a combination of particular closure and container structure including a selection of appropriate materials of construction as provides a receptacle for any variety of products and/or contents desirably contained safely out of reach or inaccessible to children or others of impaired mental faculties as might be harmed by the contents.

The contents may take the form of any one of a number of liquid or solid medicines, pills, prescriptions, treatments and, as well, other fluids, such as chemicals, soaps, detergents, solvents and the like, which could be harmful to the unknowing person.

The container industry, the closure industry and, as well, other industries engaged in the manufacture and sale of products of the type concerned have been for some time engaged in a search for and the development of a package, such as a container and closure combination or variant thereof, which would embody constructional features which would preclude accidental or less than a purposeful obtaining or gaining access to the contents of the package containing the particular product. Considerable efforts have been expended, albeit without arriving at a package which is universally acceptable by the variety of manufacturers for the variety of products for which such a package has utility. While a number of packages have been developed, a principal objection to the presently existing ones resides in the excessive cost of manufacture, usually due to the multiple parts involved.

A particularly notorious situation is involved in the packaging of products which are poisonous to a particular segment of the population such as children or to certain children or adults who might be susceptible to a given drug and/or product. Aspirin is exemplary of the largest single culprit in child poisonings. Another problem which exists with respect to present child-deterrent packages resides in the fact that they are not liquid-tight. Furthermore, some of the closure/package combinations, while frustrating to children and thus constituting a partial solution to the problem, are also difficult to open for adults. Many of the presently developed packages also require, particularly if it is a specially developed closure, a special container and therefore this is a considerable liability. Still other closure arrangements require that the container be inverted before disengagement of the safety lock feature. This, of course, can be particularly and significantly messy with certain liquids. It can also be dangerous with certain liquids. It is also known, as previously indicated, that some of the present caps on the market, allegedly designed to prevent child entry, are composed of two or more pieces with attendant disadvantages in manufacture and, as well, cost. With the foregoing brief introduction, it may be stated that it is a general object of the present invention to provide a combination of closure and container which embodies features of construction and material selection which permit the manufacture of a child-deterrent package which is avoidative of the problems presently demonstrated by packages on the market and at the same time embodies a large number of features which are nowhere to be found in any of the existing products.

It is a particular object of the present invention to provide a combination of container and closure which embodies a safety lock feature which frustrates opening by a child but is relatively easily opened by a person exercising a purposeful and intelligent mind-hand co-operative opening effort.

It is a significant object of the present invention to provide such a combination of container and closure which embodies a screw thread principal closure arrangement whereby the package is eminently suitable for fluid-tight closure, thus making the package eminently suitable for the containing of liquid products.

It is still another object of the present invention to provide such a container and closure combination which, upon operative engagement of the safety lock feature, provides an audible noise, thereby satisfying the one applying the closure to the container that the device is in the fully closed and safe position.

It is yet another object of the present invention to provide a container and closure combination which is capable of manufacture with conventional equipment used in the manufacture of containers, both glass and plastic, and the conventional closure making machinery, both metal and plastic, without any substantially burdensome modifications, whereby any cost factor, as compared to a conventional container and closure device not embodying a safety lock or a child-deterrent feature, is not excessive or even significant. Conventional plastic molding techniques are, of course, usable without difficulty.

It is still another object of the present invention to provide such a container and closure combination which, by reason of the design of the component parts, is capable of being easily assembled together by the user utilizing conventional capping machines normally employed following the filling line.

It is a particular object of the present invention to provide a combination of closure and container which embodies a resilient and consequently deformable segment of either the container or the closure to permit a purposeful disengagement of the locked-together engagement means as to permit opening of the container by one capable of performing the act of purposeful deflection to accomplish said disengagement while precluding accidental disengagement and opening of the container and/or closure. Hand in hand with the present object and desirably in combination thereof, it is most preferable that the principal engagement of the container and the closure be accomplished utilizing the screw thread type of engagement.

In accordance with a further embodiment of the present invention, it is possible and frequently desirable to design the location of the projections or tabs and the corresponding dents or recesses in such a manner that the engagement thereof is accomplished at precisely the same time that the underside of the descending cap, as provided by engagement of the screw threads, assumes sealing engagement with the upper rim of the neck of the container. The safety lock feature being thus engaged will preclude any accidental loosening of the closure from the container neck as might otherwise occur by reason of the space between the projection and the recess as present in the embodiments illustrated and by reason of the tendency of some plastics to experience the phenomena of "cap creeping". The latter is especially associated with polyethylene.

The foregoing, as well as other objects of the present invention, will become apparent to those skilled in the art from the following detailed description taken in conjunction with the annexed four sheets of drawings on which there are presented, for purposes of illustration only, several embodiments of the present invention.

IN THE DRAWINGS

FIG. 1 is a perspective view of the upper portion of a container and, positioned thereabove, a closure; the two pieces illustrated representing a construction in accordance with the present invention;

FIG. 1*a* is a schematic top plan view of the closure of FIG. 1;

FIG. 15 is a perspective view similar to FIGS. 1 and 8 of a container and closure illustrating a further embodiment of the present invention;

FIG. 16 is a vertical sectional view showing the relationship of the container and the closure in the fully sealed and locked position;

FIG. 17 is a sectional view taken on the line 17—17 of FIG. 16;

FIG. 18 is a vertical sectional view showing the relationship of the container and closure with the latter partially opened but still locked;

FIG. 19 is a sectional view taken on the line 19—19 of FIG. 18;

FIG. 20 is a vertical sectional view showing the relationship of the resilient closure when hand manipulated to release the safety lock feature;

FIG. 21 is a sectional view taken on the line 21—21 of FIG. 20;

FIG. 22 is a plan view of a tool or key useful in connection with the embodiment of FIGS. 15 to 21;

Figure 2:
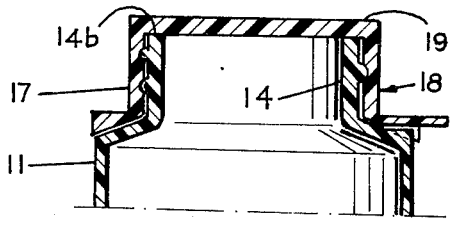
FIG. 2 is a vertical sectional view of the container and closure of FIG. 1 in the fully closed and sealed position.

Considered most basically, a container and closure in accordance with present invention feature a construction wherein one of the container or closure is provided with a dent or recess and the other is provided with a projection or a tongue-like stop engageable with the dent or recess; the two being appropriately located that, when engaged in the safety lock position, precludes accidental removal of the closure whereby the person holding the package consisting of the container, the closure and, of course, the contents will, of necessity, have to perform a mind-controlled purposeful manipulation of the package in order to disengage the safety lock feature, permitting disassemblement of the closure from the container whereby access can be had to the interior and thus the contents.

It is an important feature of the present invention that one holding the package consisting of the container and the closure will not, with normal hand manipulation of a casual nature or using a conventional unscrewing motion, be able to open the container by removal of the closure. To the contrary, the one holding the package will, of necessity, be required to perceive and comprehend instructions contained on or attached to the package before he can successfully and purposefully manipulate the package or some component thereof whereby the safety lock feature is disengaged, permitting further opening of the package to gain access to the interior of the container and, of course, whatever it contains. The instructions may be in the form of printed instructions on a label affixed to the container, the closure or the carton containing the package. The instructions may also be imprinted into the container.

The package consisting of specially designed container and closure in accordance with the present invention may feature instructions in the form of color coding, a numeral indexing or any variety or combination of key-guided manipulation of the package. At the same time, it must be noted that once the key or code is known, appropriate manipulation of the package is easily accomplished, permitting intelligent access to the contents, but at the same time precluding access to the contents by one not capable of perceiving or appreciating the instructions or the key coding or the like.

It is appreciated that even one of very tender years quickly learns how to unscrew a cap from, for example, an aspirin bottle. It is the experience and observation that such a person, when provided with a package embodying the features of construction in accordance with the present invention, will be unable to open the package and that the initial failure quickly discourages any further attempts whereby the contents are not exposed or made available to the child of tender years.

It is a significant feature of the container/closure combination of the present invention that the combination is particularly useful in the packaging of liquid products providing a completely leak-proof closure, albeit embodying a safety lock, precluding accidental disengagement of the safety lock feature. A significant feature resides in the fact that the safety lock becomes operative while the closure is being applied; that is, screwed onto the neck of the container. Thus, at a given point of screw application of the cap or closure, the safety lock feature becomes operative and the cap can no longer be simply unscrewed. On the other hand, the cap can be continued to be screwed onto the neck portion whereby the top wall achieves sealing engagement with the upper circular rim of the container, thereby completely sealing the container. It will be appreciated that appropriate gaskets and plastic inner liners of various sorts may be used on the underside of the closure cap or top wall to increase the sealing efficiency due to the resilient or deformable character of the liner, gasket or plastic seal ring, etc.

The exact nature of the construction of the present invention will become more readily apparent by detailed examination of the drawings and the following description in which the component parts and segments of the closure and container will be identified by appropriate reference numerals and figure numbers to assist in the understanding of the cooperative relationship of the parts and the appropriate constructional features constituting preferred embodiments of the present invention.

Figure 1:
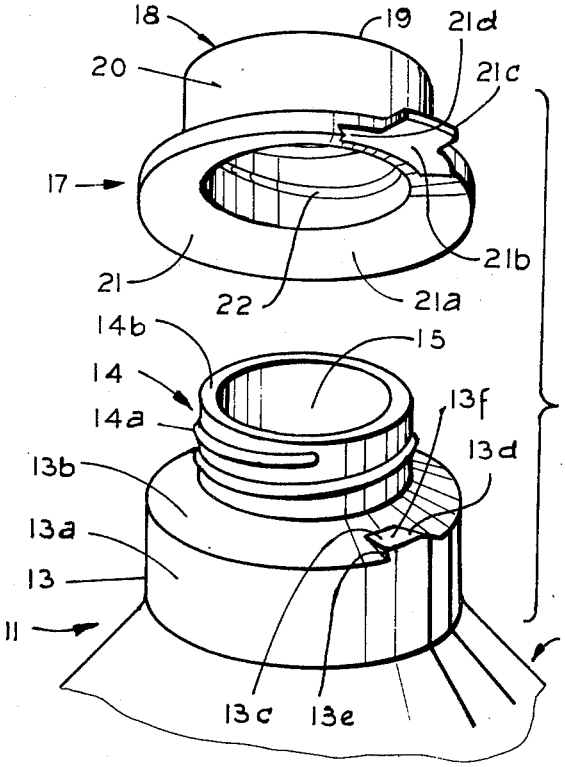
Figure 1A:
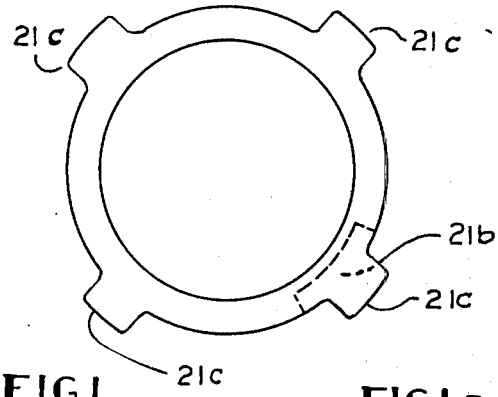

For a further and more full understanding of the nature of the closure/container package of the present invention, reference should be had to FIGS. 1–7, wherein there is disclosed a package consisting of a container and closure combination shown in various positions, one relative to the other, and in which drawings like numerals will be used to identify common parts. In these FIGS. 1–7, the reference numeral 11 identifies the container having a principal hollow body 12, an annular integral collar 13 and a cylindrical neck 14; all of these parts being connected together; the latter two defining a dispensing opening 15. The annular collar includes a continuous annular surface 13*a* and an upper shoulder 13*b*. A projection or tab 13*c* is formed on the shoulder 13*b*; the latter being inclined downwardly and extending from the neck 14 to the vertical annular surface 13*a*. The projection or tab 13*c* includes a slanted segment 13*d* and a vertical stop portion 13*e* in spaced relation to each other. Reference numeral 13*f* defines the upper surface of the tab. The neck portion 14 has male threads 14*a* formed on the exterior surface thereof and terminates at an upper rim or finish 14*b*. The rim 14*b* forms the sealing surface for the closure cap 17 which is shown in FIG. 1 positioned thereabove. The closure 17 includes an inverted cup-shaped member 18 including a top wall 19, a connected depending skirt 20 and an annular flange 21 connected thereto at the base; said flange flaring radially outwardly. The inner surface of the inverted cap segment 20 has formed on the interior surface female thread recesses 22 which engage the male threads 14*a* formed on the neck 14 of container 11. The outwardly flaring flange 21 has formed on its underside surface 21*a* a recess or dent 21*b* and extending outwardly therefrom a tab 21*c*. In keeping with the purposes of the invention, a plurality of tabs are formed on the flange but only one with the recess is shown. The cap or closure 17 is desirably formed of a resilient material whereby finger deflection in an upward direction of the tongue or tab 21*c* will cause the adjacent region of the flange to become displaced in an upward direction in the manner illustrated in FIG. 6.

Figure 3:
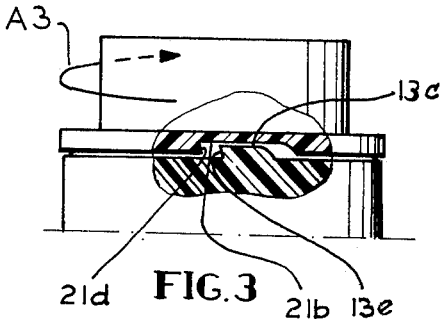
FIG. 3 is a side elevation view of the combination of the container and the closure of FIG. 1, but with a portion broken away, serving to illustrate the relative position of the safety lock feature in the fully closed and sealed position.
Figure 4:
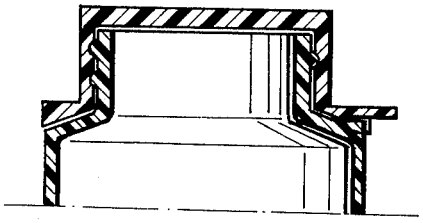
FIG. 4 is a vertical sectional view similar to that of FIG. 2, but with the closure and container in different axial relationship.
Figure 5:
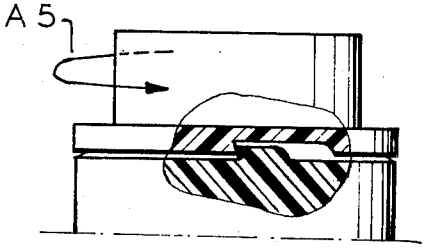
FIG. 5 is a side view similar to FIG. 3 with portions broken away, but showing the relationship of the closure and container as seen in FIG. 1 with the seal broken but with the closure still affixed to the container in a manner precluding opening in an accidental manner.
Figure 6:
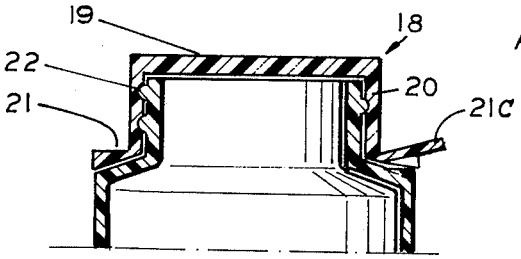
FIG. 6 is a vertical sectional view (similar to FIGS. 2 and 4) of the closure and container in yet a different axial relationship.
Figure 7:
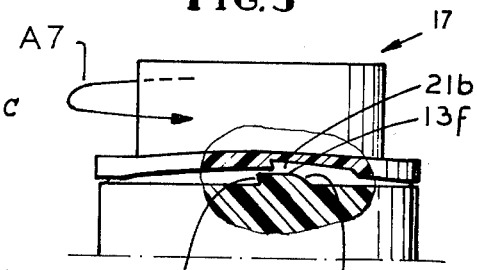
FIG. 7 is a side elevation view of the closure and container as seen in FIG. 6 with a segment broken away for purposes of showing purposeful disengagement of the locking feature in accordance with the present invention.

The package composed of container 11 and closure 17 is shown in FIGS. 2 and 3 with the closure 17 fully threadingly engaged, creating a fluid seal with the rim of the neck portion of the container. Thus, the closure has been turned clockwise in the direction indicated by the arrow A-3 (FIG. 3) whereby the male threads 14*a* and the female thread recesses 22 have brought the underside of the top wall 19 into flush sealing engagement with the upper annular rim 14*b*. In this position (see FIG. 3), the upstanding projection or tab 13*c* is recessed into the dent or recess 21*b* with a space between the stop edge 13*e* of the tab and the edge 21*d* of the recess. Now to commence opening the container, the closure is turned as in FIG. 5, in the direction indicated by the arrow A-5, bringing the edge 21*d* of the recess or dent against the edge 13*e* of the upstanding tab, whereupon the closure/container combination is prevented from being further opened. At this point, a child is thwarted in further efforts to open the closure by rotation thereof. Purposeful opening of the combination is achieved by a mind-controlled thumb or finger movement of the tongue or tab 21*c* in the upward direction, as indicated in FIG. 6, whereupon the adjacent region of the flange moves upwardly, bending about the joinder of the skirt portion 20 and the flange 21, lifting the dent or recess up above the tab or projection 13 whereupon continued counterclockwise movement of the closure 17 in the direction indicated by the arrow A-7 in FIG. 7 permits the cap to be further moved in the counterclockwise direction whereby the closure and the neck can be further disengaged via the movement of the cap on the thread region. As has been referred to, the closure 17 in accordance with the embodiment of FIGS. 1-7 will, in fact, feature a plurality (at least 2 and preferably 3 or 4) of the radially extending tabs 21*c* extending from the shoulder or flared shoulder 21. Only one of the radially extending tabs, however, will be provided with the undercut recess region 21*b*. As a consequence of such construction, the child or one not aware of the instructions or code imprinted on the package will not know just what tab may be or should be lifted in order to flex the recess upwardly out of engagement with the projection 13*f*. The label or instructions will contain specific instructions as to which tab has the undercut recess on it, such that upward manipulation thereof will permit release of the safety lock feature as described.

Figure 8:
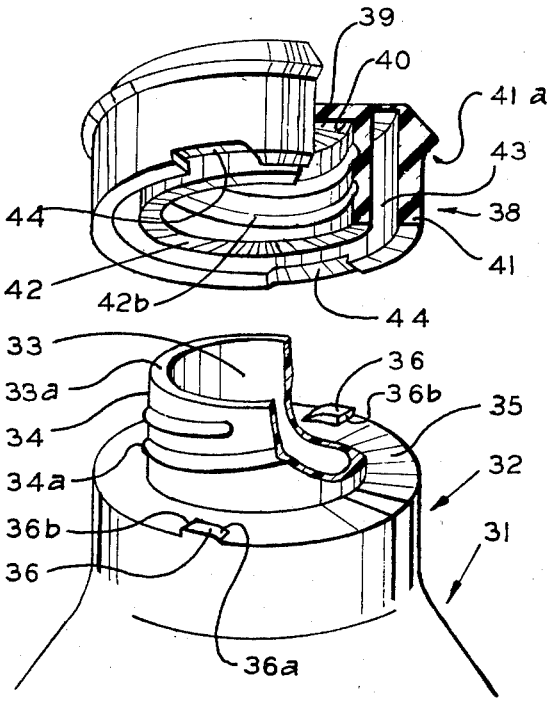
FIG. 8 is a perspective view of a container, particularly the upper neck defined opening region, and a closure situated thereabove; the container and closure representing an alternative embodiment of the present invention.

A combination of closure cap and container structure representing a further embodiment of the present invention is illustrated in FIGS. 8–14. FIG. 8 is a perspective view illustrating both components, while FIGS. 9–14 are sectional and elevation views illustrating the relationship of the engaging portions of the closure and container neck in various positions; sealed, partially sealed but locked and partially opened and unlocked.

Reference numeral 31 identifies a container, similar to container 11 of FIG. 1. The container includes a shoulder portion 32 and thereabove dispensing opening 33 surrounded by an upstanding threaded neck portion 34; the threads themselves being identified by the reference numeral 34*a*. A rim 33*a* tops the neck. The shoulder region 32 includes a horizontal annular shoulder 35 having diametrically opposed projections 36 formed thereon. The projections include an inclined portion 36*a* and a vertical stop wall 36*B*. The closure cap 38 includes a major top wall 39 adapted to span the opening 33 and having an underside 40 adapted to abut rim 33*a*. Depending from the top wall 39 are a pair of concentric annular skirt portions 41 and 42 separated by an annular space 43. The outer and inner walls of the cap are connected by a web region 45 and the entire closure is desirably formed of a material such as plastic, for example, a polyethylene, so that the web portion 45 is capable of repeated flexing, permitting the movement of the walls 41 and 42 in a vertical direction relative to each other. The outermost depending skirt 41 includes an annular projection 41*a*, while the inner depending skirt 42 has female screw thread recesses 42*b* formed therein for engagement with the threads 34*a* on the neck of the container. The outer skirt 41 also includes a pair of diametrically opposed recesses 44 formed on the underside, as shown. The recesses 44 and the projections 36 on the container shoulder function in the manner to be described in the assemblement and disassemblement of the closure/container combination to provide the safety lock feature of the present invention.

Figure 9:
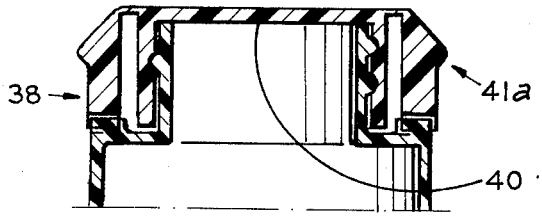
FIG. 9 is a vertical sectional view showing the closure and container of FIG. 8 fully assembled and sealed.
Figure 10:
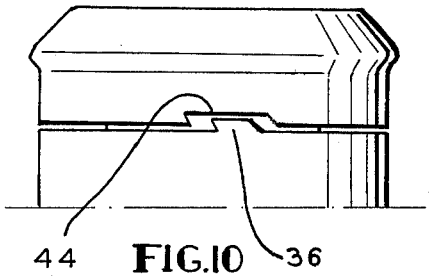
FIG. 10 is a side elevation view and particularly showing the relationship of the locking feature when the container is fully closed.
Figure 11:
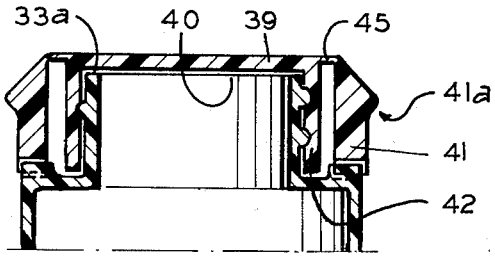
FIG. 11 is a view similar to FIG. 9 of the container and closure but with the seal broken while the safety lock feature is still in the arrest position.
Figure 12:
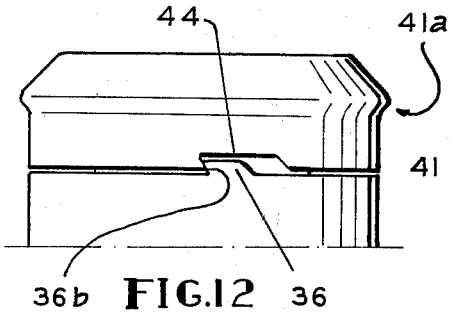
FIG. 12 is a side elevation view showing the relationship of the safety lock feature in the position illustrated in FIG. 11.
Figure 13:
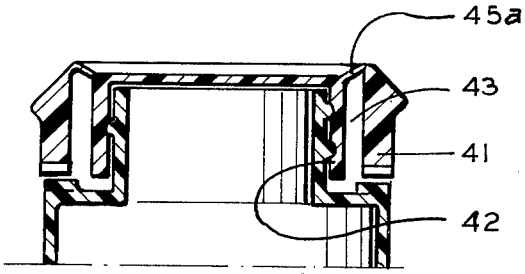
FIG. 13 is a vertical section of the container neck region and the closure showing a purposeful opening technique.
Figure 14:
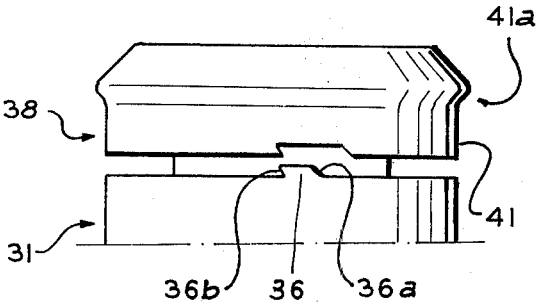
FIG. 14 is a side elevation view and showing the purposeful opening of the closure for removal of the closure from the container.

FIGS. 9 and 10 show and illustrate the closure in the fully sealed position. The closure cap 38 has been screwed clockwise by threaded engagement of the cooperating parts to bring the underside surface 40 of the top wall 39 into physical sealing contacting relationship with the upper rim 33*a* of the threaded neck 34. In this position, as shown in FIG. 10, the projections 36 (one being shown) are substantially in radial registry or orientation with the recesses 44. FIGS. 11 and 12 illustrate initial phases of disassemblement of the cap from the container. The closure is turned in the counterclockwise direction to bring the edge of the recess 44 into abutment with the stop wall 36*b* of the projections 36. The same thing is happening on the other side of the container.

In the position shown in FIGS. 11 and 12, the underside 40 of the closure top wall 39 no longer abuts the upper rim 33*a*. Further opening of the closure, however, is prevented by the contact of the edge of the recess 44 with the abutment edges 36*b* on the upstanding projections 36. A child is thus deterred from any further opening of the package arrangement as thus far illustrated in this embodiment. A more mature person capable of exercising a thought or mind-action handling of the package can, however, open the package in the manner illustrated in FIGS. 13 and 14. Thus, the mature person can with his fingers, particularly the contact of the thumb and forefinger with the annular rib-like member 41*a* on the cap, lift same, as permitted by a flexing of the region identified as web 45 and identified in FIG. 13 by the reference numeral 45*a*, showing the web in the slanted position with the inner wall of the closure identified by the reference numeral 42 still engaged with the threads on the neck of the container while the outer wall 41 has been moved upwardly in the vertical direction, effecting a disengagement of the projections 36 and the recesses 44. Simultaneously, the closure can be turned in the counterclockwise direction, causing further disengagement of the threads and ultimate movement of the closure to the position shown in FIG. 8. Replacement of the closure is easily effected in the normal manner. The closure is applied to the neck and then turned in the clockwise direction. As engagement continues, the underside of the closure outer wall 41 will contact the incline 36*a* of the projections 36, causing a slight vertical displacement of the inner and outer walls 42 and 41 by means of the flexibility of the web 45*a*. As the closure approaches the fully closed position, the recesses 44 will fully envelop the upstanding projections 36 and the outer wall move rapidly in a vertically downward position, accompanied by an audible snap as the closure reaches the position shown in FIG. 12, which is the fully locked position. Continued clockwise movement of the closure will cause the closure and the container to occupy the relative position shown in FIGS. 9 and 10, wherein the container is fully sealed in the manner described hereinbefore.

It will be appreciated that a wide variety of materials may be employed in fabricating the closure and, as well, the container. As indicated hereinbefore, the container may be formed of metal, glass or any suitable rigid or semi-rigid plastic materials, having in mind the product characteristics. The closure in the embodiment of FIG. 11 should be formed of a relatively flexible material, whereby the web region 45 connecting the outer and inner depending skirt portions can flex repeatedly as occasioned by repeated openings and closings of the package. It will be appreciated that the particular dimensions in terms of wall thickness, etc., particularly as to the outer and inner wall members 41 and 42 and the connecting web 45, may be varied to meet the properties of the specific plastic material. The latter, of course, may be selected, having in mind perhaps the nature of the contents or the specific environmental conditions to be encountered by the package.

A closure/container construction including the safety lock feature, requiring purposeful mind-action removal of the closure, and representing an alternate embodiment of the present invention is illustrated in FIGS. 15–21. Referring to FIG. 15, the reference numeral 50 designates a container featuring a body portion 51 and an upstanding neck 52 surrounding a dispensing opening 53. The upper region of the neck is provided with threads 54 for engagement with like threads on the closure to be described hereinafter. The lower region of the neck includes diametrically opposed planar surfaces 55 and 56 and opposed projections 57 and 58.

These projections each feature a sloping surface 57*a* and 58*a* and stop surfaces 57*b* and 58*b*, The projections 57 extend outwardly from the surface of the neck 52. The opening 53 is surrounded by an annular rim 53*a*. The closure itself identified by the reference numeral 60 includes a top wall 61 and, connectingly depending therefrom, a skirt 62 having on its inner surface female thread grooves 63 for engagement with the threads 54 on the container. Also on the inner surface of the skirt are formed a pair of projections 64 and 65, generally similarly configurated to the projections 57 and 58 on the container. FIGS. 16 and 17 show the closure threadingly and sealingly engaged with the container; that is, with the top wall 61 pressed firmly against the rim 53*a*. In this position, the closure has been applied to its fullest extent by turning in the clockwise direction. Referring particularly to FIG. 17, it can be seen that there is a space 62 between the skirt and the flattened surface 56 of the container and a similar space 62*a* between the flattened surface 55 of the container and the annular skirt. The projections 64 and 65 on the skirt are located slightly radially clockwise from the projections 57 and 58 on the container in this closed position. FIGS. 18 and 19 show the relative position of the component parts of the closure and the container after the closure has been turned in the counterclockwise direction to bring the projections on the respective closure and container into stopping abutment, preventing further unscrewing of the closure. This counterclockwise movement via the threading connection has caused the top wall to move upwardly off of the rim 53*a*. As indicated, further counterclockwise movement and opening of the closure is prevented by the abutment of the projections, thereby thwarting any accidental opening of the container. In order for the person to gain access to the contents, such person must compress the closure, particularly the skirt region, at diametrically opposed regions 66 and 67 (FIG. 21); the closure being made of a somewhat resilient material. The diametrically opposed pressure applied as indicated will cause the skirt to flex or bow outwardly at regions 90° disposed, that is, corresponding to the location of the inner projections 64 and 65 and in the manner illustrated in FIG. 21, whereby the respective projections 64 and 65 on the closure skirt 62 and the projections 57 and 58 on the container are not in abutment, allowing further counterclockwise movement of the threading connection. This disengagement of the abutting projections is also shown in FIG. 20. Continued unscrewing will untimately cause the projections on the closure to lie in a plane above the radial projections on the neck, whereby the threading disassemblement or disengagement can continue to the point that the threads are no longer engaged and the closure can be lifted completely off to permit purposeful access to the contents within the container. With the above description in mind, it will be appreciated that the package of the just-described embodiment represents a very desirable and very easily manufactured package embodying the safety lock feature, yet allowing a purposeful mind/-hand manipulation of the component parts as to permit opening of the package but satisfactorily precluding accidental opening or less than purposeful opening of the container. The region of the skirt to be compressed to accomplish opening can be indicated by suitable instructions or coding imprinted on the label, container or closure.

FIG. 22 illustrates an opener member 70 in the nature of a key device for ease in opening the container/-closure package of the embodiment of FIGS. 15–21. The key member 70 includes hand-hold portions 71 and 71*a* and an oval-shaped aperture 72 which is adapted to telescopically receive the closure skirt. When the aperture is forced down onto the skirt portion, the latter will be forced into the oval configuration illustrated in FIG. 21, whereby rotation of the closure can be continued until removal is accomplished. This type of arrangement is usually provided only where extreme opening difficulty is desired.

Figure 24:
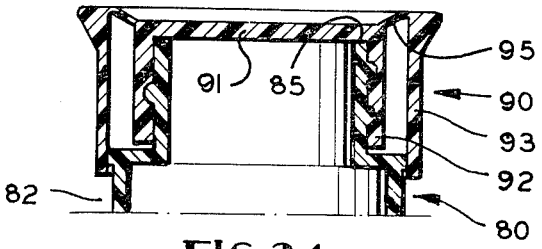
FIG. 24 is a vertical sectional view showing the container and closure in fully sealed engagement with the container.
Figure 25:
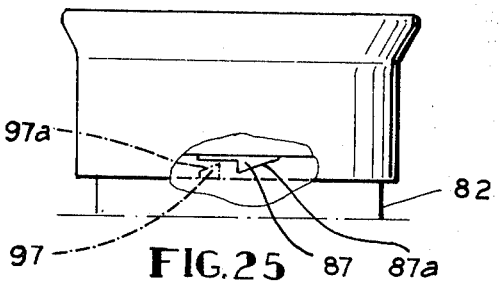
FIG. 25 is a side elevation view with portions broken away for purposes of showing the relationship of the locking components of the closure and container in the position of FIG. 24.
Figure 26:
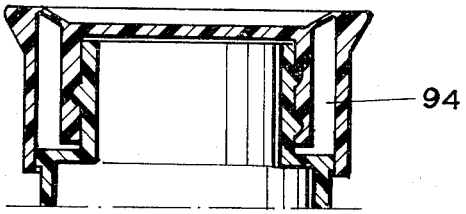
FIG. 26 is a vertical sectional view like FIG. 24, but with the closure and container in slightly different axial relationship.
Figure 27:
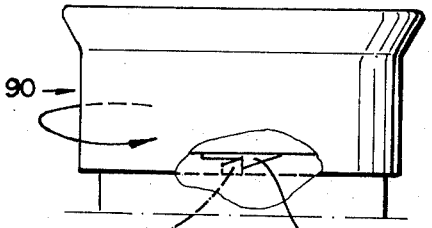
FIG. 27 is a side elevation view with parts broken away and serving to illustrate the relationship of the locking portions of the closure and container in the relative position shown in FIG. 26.
Figure 28:
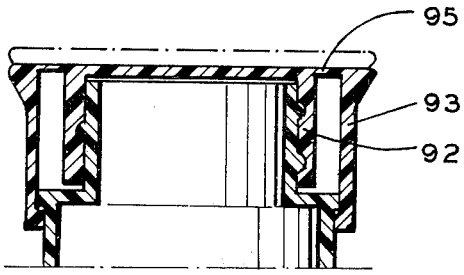
FIG. 28 is a vertical sectional view of the closure and container with the respective parts shown during disengagement of the locking parts.
Figure 29:
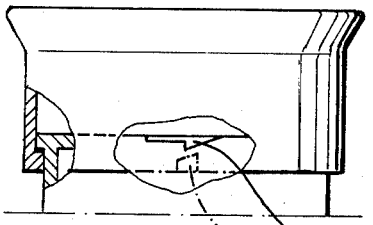
FIG. 29 is a side elevation view, partly in section, showing the position of the locking components of the container and closure in the position shown in FIG. 28.
Figure 23:
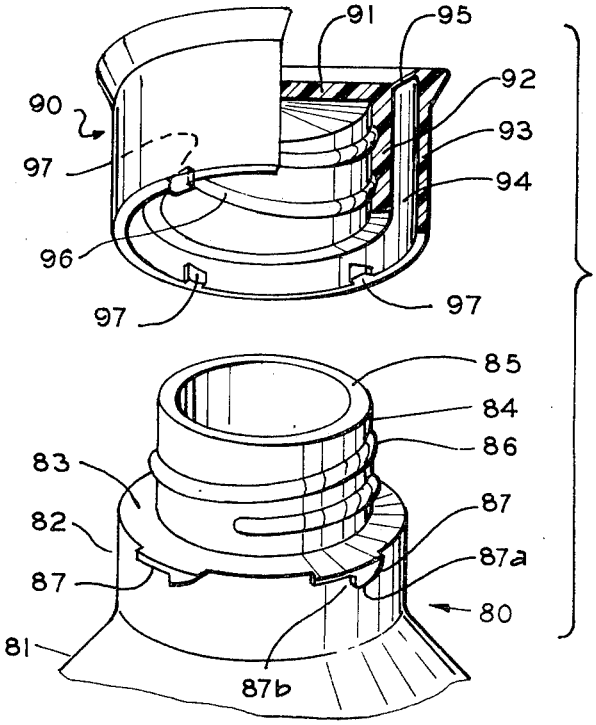
FIG. 23 is a perspective view of a closure and container structure serving to illustrate features of construction which represent a further alternative embodiment of the present invention.

Referring now to FIGS. 23–29, there is disclosed in considerable detail a container/closure combination which embodies features of construction, and particularly a locking arrangement as well as a disengaging procedure structure, representing a further embodiment of the present invention. Reference numeral 80 identifies a container having a principal body 81 and an upstanding neck 82; the latter including an annular shoulder 83 from which upstands the neck 84, terminating in the opening surrounding rim 85. The neck 84 has threads 86 formed externally thereof. The collar 82 and the annular surface 83 have formed thereon, as can be seen, projections 87 which extend outwardly and downwardly in the manner illustrated. For purposes of balance, the container should include two or more of these stop members 87, and preferably four. The members 87 include a downwardly inclined surface 87*a* and a vertical surface 87*b*. The cap designated by the reference numeral 90 includes a top wall 91, a connecting depending inner skirt 92 and a connecting depending outer skirt 93; the latter two being separated by an annular channel 94 and the concentric walls 92 and 93 being connected by a web 95 coextensive with wall 91; the web being relatively flexible. The inner skirt 92 has formed on its inner surface a female screw recess 96 accommodating engagement with the threads 86. The outer depending skirt 93 includes around the bottom edge a plurality of projections 97, of which there are three of four shown. The number should correspond to the number of projections 87 on the neck. These latter stop members 97 are predeterminedly located with respect to the stop members 87 on the collar and the design of the threads as to provide a locking feature when the closure is fully engaged in a sealing manner, as illustrated in FIGS. 24 and 25. There it can be seen that the cap 90 is fully threadingly engaged with the neck 84 and with the top wall 91 sealingly pressing against the rim 85. This has been accomplished by a clockwise turning of the closure onto the neck. In this fully engaged and sealed position, reference to FIG. 25 reveals that the stop member 97 is radially disposed clockwise a little bit past the stop member 87 formed on the collar 82 of the container. In engaging the cap onto the closure neck, the projections are enabled to move past each other into the position shown in FIG. 25 by reason of the inclined surfaces 87*a* and 97*a* of the respective projections and also by the flexibility of the web portion 95 which allows some relative vertical shifting of the wall skirt portions 92 and 93. Disengagement of the closure is prevented by the locking feature and due to the abutting contact of the member 87 and 97 when it is attempted to conventionally rotate the closure in a counterclockwise direction. This is shown in FIGS. 26 and 27; the former showing that the closure top wall has lifted from sealing engagement with the top rim of the container. Any continued counterclockwise turning of the closure, however, is not possible and the person attempting to open the container is thwarted in his attempt to do so. A mind-controlled action is necessary to accomplish disengagement of the stop projections and continue counterclockwise movement of the closure leading to the threading disengagement and removal of the closure. This is illustrated in FIGS. 28 and 29. Thus, one reading the instructions on the label or the container can be advised that to further open the package, it is necessary to move the outer skirt 93 in a vertically downward direction with the thumb and fingers; which downward movement is permitted by the flexible nature of the web 95 connecting the inner skirt 92 and the outer skirt 93. Thus, the web moves into a position which is best described as horizontal. In this position, reference to FIG. 29 reveals that the stop members 87 and 97 are vertically displaced sufficiently to allow them to move past each other as continued counterclockwise rotation is imparted to the closure. This counterclockwise rotation is conveniently continued, while at the same time imparting a downward movement to the outer skirt until such time as the natural resiliency of the web will permit the outer wall and the stop member integral therewith to move or snap back to its relaxed or natural position; in which case, the stop member 97 will be situated above the horizontal plane of the stop member 87 on the container collar. Following this, normal counterclockwise movement of the closure will result in an ultimate disengagement of the thread portions of each, allowing the closure to be removed and access to be had to the interior for whatever contents are desired.

It will be appreciated that the embodiment illustrated in FIGS. 23–29 is similar in many respects to the embodiment illustrated in FIGS. 8–15.

It will, of course, be appreciated that the locking components, that is, the recess or dent and the projection or tab, while shown for purposes of illustration on one or the other of the container or the closure, may, in fact, have their location reversed. Thus, in the embodiments of FIGS. 1–7, the closure features the recess or dent 21*b*, while the container neck portion features the upstanding projection 13*c*. It is possible within the framework of the present invention to reverse the just-described features of construction so that the container shoulder would contain the recess and the closure flange would contain the projection or tab. The foregoing is also possible with the other embodiments illustrated in the various drawings.

As indicated herein, the screw thread type of engagement of closure and container is preferred in accordance with the present invention. It will be understood, however, that in connection with the broader aspects of the present invention, one may employ other types of engagement arrangements such as the lug type of cap which may be manufactured for engagement with corresponding contours of the container.

For certain applications, it may be deemed desirable to design the projection or tab, e.g., the projection or tab 13*c* of FIG. 1, so that in place of having a vertical projection surface 13*e*, the surface would be more rounded off. With such a construction, a considerable counterclockwise opening torque will achieve an opening by causing a distortion or flexing of the closure without auxiliary hand manipulation of the tab 21*c*.

It is, of course, understandable and to be expected that variations in the principles of construction disclosed herein in the various embodiments may be made by one skilled in the art and it is intended that such obvious modifications, changes and substitutions are to be included within the scope of the present application, unless such changes or differences are clearly outside of the language of the appended claims.

I claim:

1. The combination of a container and a closure which comprises:

a container having an upstanding neck-defined opening, said neck having attachment means for a closure formed on the exterior surface thereof, and a closure including a top wall spanning said opening of said container, attachment means rotationally, releasably engageable with said neck attachment means, and a connected skirt which extends downwardly to embrace said neck, said top wall fluidly sealing said opening when said attachment means on said container and said closure are substantially, fully, rotationally engaged, each of said container and closure having two inner, generally vertical, abutment surfaces in generally diametric positions and which are proximately and mutually located for radially coincident registration and abutment generally as said top wall achieves sealing contact with said neck-defined opening, said respective abutment surfaces while in abutment precluding opening rotation of said closure and skirt, preventing accidental, nonpurposeful, rotational removal of said closure, said skirt and neck being constructed and arranged to allow inward lateral squeezing most effectively at points 90° displaced from said diametric inner abutments on said skirt to cause simultaneous outward lateral deflection of said closure at said abutments and consequent cessation of abutment of said abutment surfaces to thereby permit opening rotation of said closure, said closure and skirt each having regions of clearance adjacent said abutment surface, which regions of clearance and nonobstruction permit tightening rotation of said closure without further contact or deflection of said closure or said container which would otherwise induce distortion and stress therein.

2. The combination as claimed in claim 1, wherein said attachment means comprises male and female threads formed respectively on said neck and said skirt.

3. The combination as claimed in claim 1, wherein said vertical abutment surface are enclosed by said skirt and accordingly cannot be seen in side elevation.

* * * * *